United States Patent [19]

Leclabart

[11] 4,106,652

[45] Aug. 15, 1978

[54] AMPOULE

[75] Inventor: Jacques Leclabart, Vaucresson, France

[73] Assignee: Societe Anonyme Parfumerie et Chimieparchimy, Reims, France

[21] Appl. No.: 720,771

[22] Filed: Sep. 7, 1976

[30] Foreign Application Priority Data

Sep. 11, 1975 France ..... 7527830

[51] Int. Cl.[2] ..... B65D 41/46

[52] U.S. Cl. ..... 215/253

[58] Field of Search ..... 215/32, 250, 253; 222/541; 220/276

[56] References Cited

U.S. PATENT DOCUMENTS

| | | | |
|---|---|---|---|
| 1,004,402 | 9/1911 | Flack | 215/32 |
| 1,382,163 | 6/1921 | Beccari | 215/32 |
| 1,565,983 | 12/1925 | Borneman | 215/32 X |
| 2,517,604 | 8/1950 | Smith | 215/32 |
| 2,742,202 | 4/1956 | Dresden | 222/541 |
| 2,750,068 | 6/1956 | Platt | 222/541 X |

FOREIGN PATENT DOCUMENTS

| | | | |
|---|---|---|---|
| 1,392,963 | 2/1965 | France | 222/541 |
| 1,142,720 | 4/1957 | France | 215/32 |

*Primary Examiner*—Donald F. Norton

*Attorney, Agent, or Firm*—Haseltine, Lake & Waters

[57] ABSTRACT

An ampoule for containing a liquid product comprising a chamber for the liquid product defined by a wall in which are provided a weakened zone defining a portion to be torn away to provide a pouring orifice and a capillary filling orifice to be closed after filling. The portion of the wall including the weakened zone and capillary filling orifice is made of plastic material and may be provided by a stopper closing an opening defined by the remainder of the wall.

5 Claims, 9 Drawing Figures

AMPOULE

FIELD OF THE INVENTION

The present invention is concerned with ampoules for packaging liquid products, e.g. perfumery or pharmaceutical products.

BACKGROUND

Numerous pharmaceutical or perfumery products are offered in ampoules, the volume of which corresponds with one exact dose for use. In particular ampoules of glass, called single-tipped, of the type shown in FIG. 1 of the accompanying drawings are known. Such ampoules are currently produced by drawing and blowing a blob of glass. Such ampoules can be filled under vacuum in an airtight enclosure by presenting them in large batches, upside down with the drawn-out tip 1 dipping into the liquid. By creating a vacuum in the enclosure the ampoules are emptied of air, and by re-establishing atmospheric pressure the liquid rises into all the ampoules at once; they may then be withdrawn without risk of emptying because the passage in the tip is sufficiently small for atmospheric pressure to prevent the liquid from running out. The ampoules are next flame-sealed in order to shut off the orifice at the end of the tip. This technique enables very high filling rates and the sealing is a quarantee of origin to the user. In use, the tip is broken at the neck 2 which opens an orifice of sufficient area to enable the liquid to run out freely, with air entering to take the place of the liquid. Unfortunately, these glass ampoules are fragile. In addition, for products intended for use by the general public, the need to break the glass tip creates a fear of being cut, with the result that this method of presentation is not always appreciated by the customer.

Ampoules of plastic materials have therefore been devised the handling of which by the user no longer presents any risk of being cut. But such plastic ampoules, which are obtained by moulding, necessarily have an orifice of relatively large area which prevents their filling under vacuum. One is therefore obliged to fill them one by one and then to fit a stopper. This stopper is often tamperproof, that is to say, it can not be removed from the ampoule without special equipment or without the removal being visually apparent. Opening by the user is generally effected by tearing off a portion the ouline of which is weakened in the construction of the stopper itself. So the user has the same guarantees of origin with the glass ampoules. Here again the area of the orifice opened by tearing is sufficient to enable the liquid contained in the ampoule to run out freely. With present plastic ampoules, filling rates are considerably poorer than for glass ampoules with vacuum filling, and the necessity of stoppering the ampoules after filling further increases the cost of the overall filling operation and the overall price of the packaging.

SUMMARY OF THE INVENTION

According to one aspect of the invention there is provided an ampoule for containing a liquid product comprising a chamber for receiving liquid product and defined by a wall, wherein in said wall there are provided a weakened zone such as will enable a portion of said wall to be torn away to provide a pouring orifice, and a capillary filling orifice to be closed after filling, wherein at least the portion of said wall including said weakened zone and said capillary filling orifice are made of plastic material.

According to another aspect of the invention there is provided an ampoule for containing a liquid product comprising a container body having an opening, and a stopper of plastic material which is forcefitted into said opening, said stopper having a weakened zone enabling a portion of said stopper to be easily torn away to open an orifice of sufficient area to allow the product contained in said ampoule to run out normally, said stopper defining a capillary filling orifice to be closed after filling.

In a preferred form of the invention, the stopper includes a projecting nose constituting the portion of the stopper to be torn away and the capillary orifice communicates with a capillary duct passing through the nose and to be closed by heating the tip of the nose.

BRIEF DESCRIPTION OF THE DRAWINGS

The invention will be more fully understood from the following description of embodiments thereof, given by way of example only, with reference to the accompanying drawings.

In the drawings.

DETAILED DESCRIPTION

Figure 4:
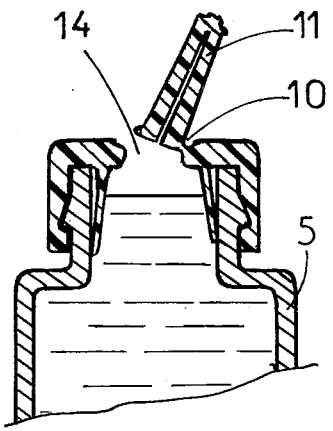
FIGS. 2, 3 and 4 show in partial diametral section an embodiment of an ampoule in accordance with the invention, FIG. 2 showing the ampoule before filling, FIG. 3 showing the ampoule filled and sealed, as distributed to customers, and FIG. 4 showing opening of the ampoule by the user.
Figure 3:
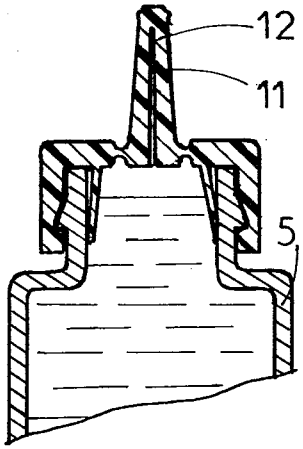
Figure 2:
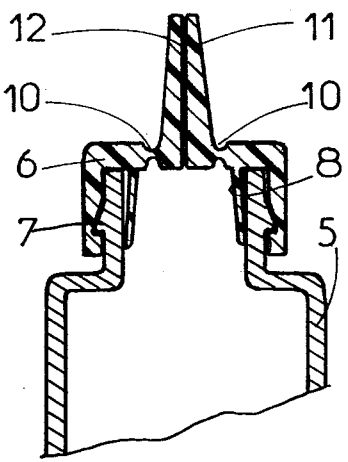
Figure 1:
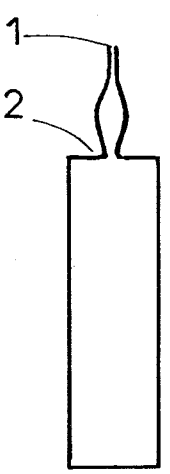
FIG 1 PRIOR ART
FIG. 1 is a schematic elevational view of a conventional glass ampoule of the single-tipped type.

Referring first to FIGS. 2, 3 and 4, the ampoule comprises a body 5 which may be made of glass, of plastic material or even of metal. The body has an opening which is closed by a stopper 6 of plastic material which includes in the usual way a groove in which a mating bead 7 formed round the neck of the ampoule is engaged to seal the stopper on the neck of the body. Sealing is completed by an internal skirt 8. Positioning of the stopper 6 on the body 5 is effected in a special machine because it is force-fitted on to the body both to ensure sealing and so that it cannot be removed inadvertently. At its top part the stopper includes a circular portion 10 which is very thin and which constitutes the base of a projecting nose 11. A duct or passage of very small cross-section 12 extends right through the nose 11 and opens at the tip of the nose in a capillary orifice.

FIG. 2 shows the finished ampoule before filling. Filling is then carried out under vacuum in the way usually employed for glass ampoules. After filling, when the ampoule is still head down, the small cross-section of the capillary duct 12 prevents the liquid from running out. After turning upright, the ampoule is sealed by fusion of the tip of the nose 11 by heat, which closes the duct 12 as shown in FIG. 3. It is in this form that the ampoule is distributed to users. For use, as shown in FIG. 4 sideways pressure of the finger on the tip of the nose 11 is sufficient to tear the base of the nose in the weakened zone 10. An orifice 14 thus opened through which the liquid can run out freely. The ampoule produced in this way therefore enables both satisfaction of the user of the product, who finds in it safety of opening, with the guarantee of a tamper-proof stopper, and satisfaction of the manufacturer of the product, who can carry out filling by the economical technique of filling under vacuum which enables high rates of filling.

Figure 5:
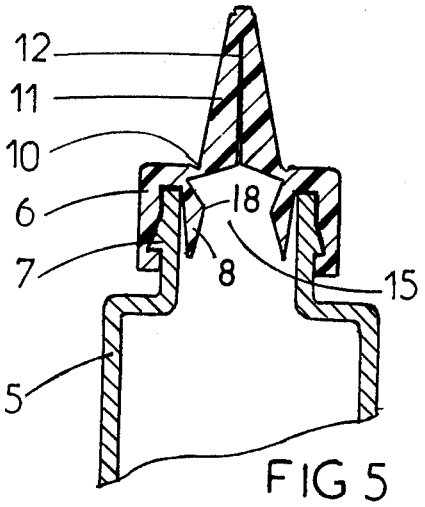
FIG. 5 is a partial sectional view and shows another embodiment of an ampoule.
Figure 6:
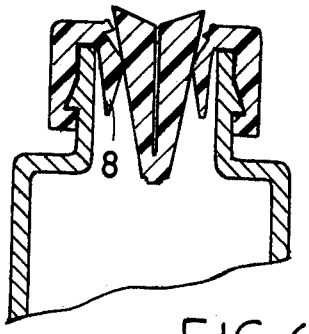
FIG. 6 is a partial sectional view and shows the embodiment of FIG. 5 with temporary restoppering of the ampoule after partial use of the contents thereof.

An ampoule in accordance with the invention may be furnished with means of restoppering the ampoule in the event of partial use of the product contained in the ampoule. In the embodiment shown in FIGS. 5 and 6, the internal skirt 8 of the stopper has an internal projection which forms a collar 18, the central opening 15 in which has a smaller diameter than the tearable region 10 at the base of the nose 11. When the nose 11 has been removed, it can serve as a stopper by inverting it and introducing it into the orifice 15 as shown in FIG. 6. Of course, it is in this case no longer a matter of restoppering in a tamper-proof manner, but temporarily restoppering sufficiently for keeping the remainder of the product in the ampoule for later use.

Figure 7:
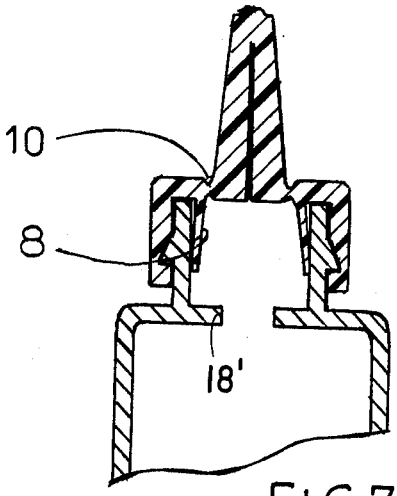
FIG. 7 is a partial sectional view of a further embodiment of the present invention.
Figure 8:
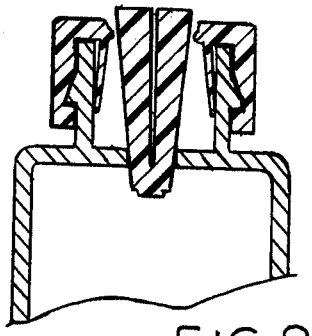
FIG. 8 is a partial sectional view of the ampoule of FIG. 7 when restoppered after partial use of its contents.

FIGS. 7 and 8 show another embodiment of an ampoule which can be restoppered. In this embodiment, the collar 18' against which the nose bears and seals is no longer integral with the stopper, but is formed inside the neck of the body of the ampoule.

Figure 9:
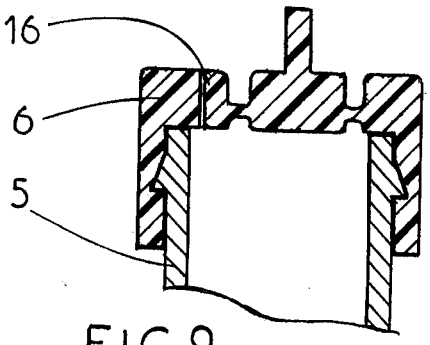
FIG. 9 shows another embodiment of the invention.

The invention is not intended to be confined to the embodiments which have just been described, but also covers embodiments which may differ from them only in detail, in matters of variants of execution or in the employment of equivalent means. Thus, the capillary duct through which the ampoule is filled under vacuum and which is closed after filling is not necessarily formed in the portion of the stopper which is torn off in use, but it may alternatively be formed in a portion of the stopper which remains on the ampoule during use. FIG. 9 shows an example of such a modification, the stopper of the ampoule being shown before filling. In this case it is clearly sufficient if the portion of the stopper at which the duct 16 opens dips in the liquid during filling. This duct may be provided by a simple orifice provided it is of very small cross-section.

Similarly the means of closure of the duct or orifice after filling may be of any kind, e.g. it may be hot-sealed or closed by a stopper. Finally, the stopper with its capillary filling duct may be fitted to a body of any shape and any suitable material, such as glass, metal or plastic material.

It will be appreciated that the invention is equally applicable to an ampoule made in one piece of plastic material, that is to say, an ampoule which does not include a separate stopper applied to the neck of the container body. An ampoule of this kind is moulded so as to provide in its wall a portion having a weakened outline so that it can be torn away to form a pouring orifice. In this case the capillary orifice is made at any suitable point of the wall, in the tearable portion or in the portion remaining after tearing. All of FIGS. 2 to 9 are applicable to this one piece type of ampoule, by simply considering that the portions 5 and 6 are integral with, of course, the local changes in shape technologically necessary to one-piece moulding.

There are thus provided ampoules which have the advantages of strength and safety of the present plastic ampoules, while at the same time enabling economical filling by the high-rate technique of filling under vacuum.

What is claimed is:

1. An ampoule for containing a liquid product and able to be filled under vacuum, said ampoule comprising a container body having a neck with an opening and a stopper of plastic material force-fitted on said body to close said opening, said stopper having a weakened zone enabling a portion of said stopper to be easily torn away to open an orifice of sufficient area to allow the product contained in said ampoule to run out normally, said stopper defining a capillary vacuum-filling orifice to be closed after filling, said stopper including a projecting nose which constitutes said portion of said stopper which is torn away, said nose being of conical shape and having a tearable base, the portion of said ampoule which remains in place after tearing off said nose including an internal collar included in the neck of the container with a central opening of smaller diameter than said base of said nose so that said nose, after removal and reversal, is introducible into said opening to re-stopper said ampoule.

2. An ampoule as claimed in claim 1, wherein said internal collar is included in the portion of said stopper which remains in place after tearing off said nose.

3. An ampoule as claimed in claim 2, wherein said internal collar is inwardly tapered.

4. An ampoule as claimed in claim 1 comprising means on said container body and on said stopper for force-fitting said stopper on said body.

5. An ampoule as claimed in claim 1 wherein said capillary orifice is in said projecting nose.

* * * * *